United States Patent [19]

Schiweck et al.

[11] 4,424,078

[45] Jan. 3, 1984

[54] METHOD FOR IMPROVING THE CARBONATION PROCEDURE IN A SUGAR PLANT

[75] Inventors: Hubert Schiweck, Worms; Günter Witte, Obrigheim, both of Fed. Rep. of Germany

[73] Assignee: Suedeutsche Zucker-Aktiengesellschaft, Mannheim, Fed. Rep. of Germany

[21] Appl. No.: 406,092

[22] Filed: Aug. 6, 1982

Related U.S. Application Data

[63] Continuation of Ser. No. 151,654, May 20, 1980, abandoned.

[30] Foreign Application Priority Data

Jun. 22, 1979 [DE] Fed. Rep. of Germany ..... 2925283

[51] Int. Cl.[3] ..... C13D 3/06

[52] U.S. Cl. ..... 127/50; 127/52

[58] Field of Search ..... 127/50, 52, 12

[56] References Cited

U.S. PATENT DOCUMENTS

| | | | |
|---|---|---|---|
| 1,755,165 | 4/1930 | Bull | 127/50 |
| 1,941,461 | 1/1934 | Bull et al. | 127/50 |
| 2,164,186 | 6/1939 | Brown et al. | 127/50 |
| 3,834,941 | 9/1974 | Schoenrock et al. | 127/52 |

FOREIGN PATENT DOCUMENTS 719370 3/1942 Fed. Rep. of Germany .

*Primary Examiner*—Peter Chin

*Attorney, Agent, or Firm*—Armstrong, Nikaido, Marmelstein & Kubovcik

[57] ABSTRACT

Lime-treated juice in a sugar plant is carbonated in a first stage and a second stage with a carbon dioxide-containing gas to remove lime and impurities therefrom. Exhaust gas from the second stage is recycled to the first stage. Heat can be recovered from exhaust gas from the first stage and from the second stage.

2 Claims, No Drawings

METHOD FOR IMPROVING THE CARBONATION PROCEDURE IN A SUGAR PLANT

This is a continuation of application Ser. No. 151,654, filed May 20, 1980 now abandoned.

BACKGROUND OF THE INVENTION

1. Field of the Invention

This invention is in the field of sugar fabrication.

More particularly, this invention is directed to an improvement for juice purification of a beet sugar- or cane sugar-factory in which exhaust gas from a later-recited second carbonation stage is recycled to a later-recited first carbonation stage to conserve heat and carbonation gas.

2. Description of the Prior Art

Prior art processes for juice purification are taught by the Kirk-Othmer Encyclopedia of Chemical Technology, Second Edition, Volume 19 and by Ullmanns Encycklopädie der technischen Chemie, Third Edition, Volume 19.

In processing beet sugar or cane sugar according to the methods of the prior art and according to the method of this invention, sugar-containing juice is separated from the juice source (sugar cane or sugar beets), e.g., by milling or diffusion in the case of cane and by diffusion in case of beets. The resulting separated juice which is known as raw juice comprises water, sugar (sucrose), invert sugar, other carbohydrates, proteins, amides, amino acids, other organic acids including oxalic acid, ammonium salts, plant tissue and other organic and inorganic materials. The raw juice is treated with an excess of lime over that required to:

(a) saponify the amides;

(b) convert the ammonium salts to calcium salts and ammonia;

(c) neutralize the acids in the juice and precipitate the oxalic acid and certain other organic acids as insoluble calcium salts;

(d) coagulate plant tissue; and the like.

The lime-treated juice is carbonated, i.e., treated with a carbon dioxide-containing gas to precipitate the excess lime as calcium carbonate which is separated, along with other precipitated and coagulated material, from the resulting carbonated juice.

Carbonation is generally conducted in two steps or stages—a first carbonation and a second carbonation. Precipitated material, including calcium carbonate, is removed from the slurry formed during the first carbonation and the separated juice (which is frequently called "first thin juice") is subjected to a second carbonation to precipitate, as completely as possible, the lime remaining in the first thin liquor. Juice (which is frequently called "second thin juice") is separated from the slurry formed during the second carbonation.

Sucrose is crystallized from the second thin juice by evaporating water thereafter and the crystallized sucrose is separated and recovered.

SUMMARY OF THE INVENTION

It is an object of this invention to provide an improved two-stage carbonation procedure in a sugar plant, characterized in that exhaust gas from the second carbonation stage is recycled to the first carbonation stage.

It is another object of this invention to provide an improved two-stage carbonation procedure in a sugar plant, characterized in that: (a) exhaust gas from the second carbonation stage is recycled to the first carbonation stage; and (b) exhaust gas from the first carbonation stage is cooled by using its heat content in a heat exchanger to heat a cooler medium which can be raw juice, first thin juice after flash evaporation has been used to evaporate water therefrom, a carbon dioxide-containing gas including lime-kiln gas, or the like.

It is another object of this invention to provide an improved two-stage carbonation procedure in a sugar plant, characterized in that exhaust gas from the first carbonation stage and from the second carbonation stage are cooled together or separately while using their heat content in heat exchangers to heat a cooler medium which can be raw juice, first thin juice after flash evaporation has been used to evaporate water therefrom, a carbon dioxide-containing gas including lime-kiln gas, or the like.

It is another object of this invention to provide an improvement in a two-stage carbonation procedure in a sugar plant, the improvement comprising: (a) recycling exhaust gas from the second carbonation stage to the first carbonation stage and (b) recovering heat from exhaust gas from the first carbonation stage by passing exhaust gas from said first stage through a heat exchanger to heat a cooler medium such as raw juice, first thin juice after flash evaporation has been used to evaporate water therefrom, a carbon dioxide-containing gas including lime-kiln gas, or any other process stream in the sugar plant which requires heating and which is cooler than the exhaust gas from the first stage carbonation.

It is a further object of the invention to reduce the amount of lime-kiln gas (or other carbonation gas) required and to significantly improve the thermal economy in juice purification.

DESCRIPTION OF PREFERRED EMBODIMENTS

This invention is described in further detail below in conjunction with various preferred embodiments.

In the above-mentioned first carbonation, excess calcium hydroxide (8–15 g/l) which was added to the raw juice in the above-mentioned liming step is precipitated as calcium carbonate by introducing a gas (lime-kiln gas) containing carbon dioxide, at 80°–90° C., in order, on one hand, to generate a filtering accessory means for enclosing the precipitated colloids and a surface for adsorbing non-precipitated non-sugars, and, on the other hand, to remove the calcium hydroxide down to a residual content of about 0.7–1.4 g/l of resulting slurry (carbonated limed juice) corresponding to a pH value of 10.7–11.6 measured at 20° C. Due to the passage of the lime-kiln gas, most of the ammonia, including that formed by saponifying the amides, and other volatile substances present in the lime treated juice are removed (Ullmann, p. 221).

During the above-mentioned second carbonation, filtered juice from the first carbonation (hereinafter, first thin juice) is heated to ~100° C. and lime-kiln gas at 90°–100° C. is introduced therein to precipitate as completely as possible the calcium hydroxide (ca. 0.5–1.5 g/l) still present in the first thin juice. This treatment precipitates the calcium ions as calcium carbonate and simutaneously lowers the pH of the resulting system to 8.6–9.6, when measured at 20° C. (Ullmann, p. 222).

Prior to the instant invention fresh carbon dioxide-containing gas (e.g., fresh lime-kiln gas) was always used in both the first carbonation stage and the second carbonation stage.

Despite various designs in bubble column reactors used for carbonation, no more than about 59% of the $CO_2$ content of the lime-kiln gas can be absorbed in the first carbonation stage and no more than 45% can be absorbed in the second stage because of the equilibrium of dissociation of carbonate/hydrogen-carbonate depending on the pH and on the temperature of the system being carbonated. These ratios are fundamentally unaltered even when using cascades for contacting juice and gas (La Sucrerie Belge 97, 2, 47 (1978)).

These problems are solved by the process of this invention wherein exhaust gas from the second carbonation stage is recycled to the first carbonation stage which reduces the amount of carbonation gas required for the carbonation stages by 8–16% and also produces a considerable saving in thermal energy (about 0.6 kg of steam per 100 kg of processed beets) because part (about 40–50%) of the heat content of the water vapor-saturated gas issuing from the second carbonation stage is recovered by condensing said water vapor in the juice of the first carbonation stage which is cooler than the recycled gas by about 10°–15° C. Previous to the invention it has been overlooked that, in the conventional processing of the carbonation gases, heat, in the amount of about 4,000 kj/100 kg of processed beets corresponding to about 2.4 kg of vapor per 100 kg of processed beets is lost in the exhaust gas of the first carbonation stage.

In a rational development of the concept of this invention, it was also found that a substantial portion of the heat content of exhaust gas from the first carbonation stage can be recovered by cooling and condensing the water-vapor saturated exhaust from the first carbonation stage (which has a temperature of about 80° C.) in a heat exchanger to heat juice of a lower temperature (raw juice, pre-limed juice, or first thin juice previously cooled by flash evaporation according to German Patent No. 2 729 192) and/or to heat inflowing lime-kiln gas. In this procedure, the ammonia and the other volatile organic compounds contained in the exhaust gas from the first carbonation stage dissolve in the condensed cold water, whereby on one hand odorous emission is averted and on the other hand ammoniacal liquor is obtained as a source of nitrogen for use in the biological degradation of sugar plant waste waters.

The advantages of the invention are illustrated in the description below in which the process parameters are based on 100 kg of processed beets. Lime-kiln gas of the following composition is used for carbonation:

$CO_2$ content—40% by vol.
oxygen content—1% by vol.
nitrogen content—59% by vol.
water vapor content—0% by vol.
temperature—20° C.
pressure—1.8 bar In the first carbonation stage, 145 l of juice per 100 kg of processed beets at 85° C. and a CaO content of 12 g/l are reduced to a CaO content of 1.2 g/l by introducing lime-kiln gas.

For a $CO_2$ utilization of 59%, 4.08 kg of lime-kiln gas are required, and for conventional procedures, an exhaust gas in the amount of 4.44 kg having a temperature of 80° C. and a pressure of 1.013 bar is obtained; said exhaust gas has the following composition:

$CO_2$ content—10.8% by vol.
oxygen content—0.7% by vol.
nitrogen content—39.1% by vol.
water vapor content—49.9% by vol.

For an enthalpy of 948.8 kj/kg of exhaust gas, there is a heat of 4,213 kj per 100 kg of processed beets in the exhaust gas from the first carbonation stage.

In the second carbonation stage, 135 l of juice per 100 kg of processed beets, at 95° C. and a CaO content of 2.5 g/l is reduced to a CaO content of 0.25 g/l by introducing lime-kiln gas.

For a $CO_2$ utilization of 45%, 1.04 kg of lime-kiln gas is required with 1.96 kg of exhaust gas at 90° C. and 1.013 bar and having the following composition being obtained:

$CO_2$ content—7.4% by vol.
oxygen content—0.4% by vol.
nitrogen content—19.8% by vol.
water vapor content—72.4% by vol.

The exhaust gas from the second carbonation stage has a specific ethalpy of 1,691.5 kj/kg so that a heat of 3,174 kj/100kg of processed beets is contained in the exhaust gas from the second carbonation stage.

If the exhaust gas from the second carbonation stage is aspirated (by means of a compressor, a liquid seal pump or a steam or liquid injector) and introduced into the first carbonation stage, only 3.5 kg of lime-kiln gas will be required in the first carbonation stage to achieve the operational conditions recited supra. Accordingly, the saving in lime-kiln gas is 0.58 kg or 14%. Following this procedure, the total exhaust gas from the first carbonation stage is 5.11 kg at 82° C. and 1.013 bar, said exhaust gas having the following composition:

$CO_2$ content—9.2% by vol.—16.7% by weight
oxygen content—0.6% by vol.—0.8% by weight
nitrogen content—36.8% by vol.—42.6% by weight
water vapor content—53.4% by vol.—39.9% by weight For a specific enthalpy of 1,106.7 kj/kg, a heat of 5,655 kj/100 kg of processed beets is present in the exhaust gas from the first carbonation stage.

The heat saving by recycling the exhaust gas from the second carbonation stage into the first amounts to 1,732 kj/100 kg of beets or 0.647 kg of steam/100 kg of processed beets ($4{,}213+3{,}174-5{,}655=1{,}732$).

About 80–90% of the heat content, namely 5,655 kj/100 kg of processed beets, of the exhaust gas from the first carbonation stage is then utilized in heat exchangers to heat a cooler or colder medium, for instance raw juice at 20° C., first thin juice after flash evaporation thereof which cools the juice to 20° C., or lime-kiln gas at 20° C. About 2 kg of ammonia-containing condensate is obtained per 100 kg of beets.

Although the present invention has been described in conjunction with the foregoing preferred embodiments it is not intended to be limited thereto but, instead, includes all those embodiments within the spirit and scope of the appended claims.

We claim:

1. In a two-stage process for carbonating lime-treated juice in a sugar plant, said process comprising a first carbonation stage and a second carbonation stage, the improvement comprising: (a) recycling exhaust gas from the second carbonation stage to the first carbonation stage such that the amount of carbonation gas required in the two carbonation stages is reduced by 8 to 16 percent; and (b) cooling the exhaust gas from the first carbonation stage and/or the exhaust gas from the second carbonation stage while recovering the heat content thereof.

2. A process according to claim 1, wherein the exhaust gas from the first carbonation stage is cooled while recovering its heat content.

* * * * *